United States Patent [19]

Tanaka et al.

[11] 4,223,526

[45] Sep. 23, 1980

[54] ELECTRONIC TIMEPIECE

[75] Inventors: Teruaki Tanaka, Yokohama; Masao Kaizuka, Kawasaki; Yuichi Takagi; Mitsuo Aihara, both of Tokyo, all of Japan

[73] Assignee: Tokyo Shibaura Electric Co., Ltd., Japan

[21] Appl. No.: 874,052

[22] Filed: Jan. 31, 1978

[30] Foreign Application Priority Data

Jan. 31, 1977 [JP] Japan ..... 52-9399

[51] Int. Cl.[3] ..... G04B 19/30

[52] U.S. Cl. ..... 368/84; 340/765; 368/101; 368/102; 368/113

[58] Field of Search ..... 58/23 R, 23 A, 50 R, 58/39.5, 74, 75, 145 R, 145 A; 235/91 T, 92 TF, 92 TA, 92 F; 340/324 M, 336, 713, 765, 785, 805

[56] References Cited

U.S. PATENT DOCUMENTS

| | | | |
|---|---|---|---|
| 3,789,600 | 2/1974 | Champan | 58/74 |
| 3,795,099 | 3/1974 | Tsuruishi | 58/74 |
| 3,845,615 | 11/1974 | Cake | 58/50 R |
| 4,010,603 | 3/1977 | Forsyth | 58/39.5 |
| 4,023,345 | 5/1977 | Imamura | 58/74 |
| 4,174,606 | 11/1979 | Masuda et al. | 58/39.5 |

*Primary Examiner*—J. V. Truhe
*Assistant Examiner*—William L. Feeney
*Attorney, Agent, or Firm*—Finnegan, Henderson, Farabow, Garrett & Dunner

[57] ABSTRACT

An electronic timepiece comprises an oscillator, a frequency divider for frequency dividing the output signal of the oscillator to generate 100 Hz output pulse signals, time count circuits having a plurality of counters cascade-connected to count the output pulse signals of the frequency divider, a decoder circuit for decoding the output signal of the time count circuits to generate a display signal and a display device for displaying data corresponding to the output display signal of the decoder circuit, in which a stopwatch display mode and a normal time display mode may be selected by the operation of a switch. The electronic timepiece further includes a control circuit connected between the decoder circuit and display device and adapted to inhibit normal time display data from being supplied to the display device in response to the operation of the switch which sets the electronic timepiece into the stopwatch display mode.

12 Claims, 8 Drawing Figures

ELECTRONIC TIMEPIECE

BACKGROUND OF THE INVENTION

This invention relates to an electronic timepiece including a liquid-crystal unit adapted to be operated in either one of a normal time count mode or a stopwatch time count mode in response to a switching operation.

Electronic timepieces are known which include an alternating type liquid-crystal display unit of static or dynamic variety adapted to alternately apply positive and negative voltages to liquid-crystal segments. Out of these, an electronic timepiece is known which has the double function of: (1) counting seconds, minutes, hours, days or dates, etc. and displaying an appropriate time count value; and (2) counting any time interval for example, $t_1$ to $t_2$, and displaying its time count value (i.e., stopwatch function). Such type of electronic timepiece will be explained by referring to FIGS. 1 to 3.

In the electronic timepiece circuit shown in FIG. 1 an output signal from a crystal oscillator 1 is frequency divided by a frequency divider 2 into a 1 Hz signal. The output signal of the frequency divider 2 is supplied sequentially to a scale of ten counter 3, scale of 6 counter 4, scale of ten counter 5, scale of six counter 6, scale of ten counter 7 and scale of six counter 8 in this order. The output signals of the counters 3 to 8 are supplied respectively through AND gates 9 to 14 to decoders 15 to 20, where they are decoded. The numerical data corresponding to the output signals of the decoders 15 to 20 are displayed on a display device 21.

The output signal of the oscillator 1 is also supplied through an AND gate 22 to a frequency divider 23 where it is frequency divided into a 100 Hz signal. The 100 Hz output signal of the frequency divider 23 is sequentially supplied to the scale of ten counters 24, 25 and 26, scale of six counter 27, scale of ten counter 28 and scale of six counter 29 in this order. The outputs of these counters 24 to 29 are supplied respectively through AND gates 30 to 35 to decoders 36 to 41 where they are decoded. The numerical data corresponding to the output signal of the decoders 36 to 41 may also be displayed on the display device 21. It is to be understood that the output lines from the counters 3–8 and 24–29 actually include a plurality (e.g., four) of bit channels for transmitting, for example, a binary coded decimal (BCD) digit. Similarly, AND gates 9–14 and 30–35 actually include a plurality of AND circuits (as shown in FIG. 2) for gating the multi-channel counter outputs in parallel to the decoders.

The Q output terminal of a flip-flop circuit 42 whose state is switched by a switch SW1 is connected to the other terminal of each of the AND gates 9 to 14, and the $\overline{Q}$ output terminal of the flip-flop circuit 42 is connected to the other input terminal of the AND gates 30 to 35. The Q output terminal of a flip-flop circuit 43 whose state is switched by a switch SW2 is connected to the other terminal of the AND gate 22. The counters 24 to 29 are reset when the flip-flop circuit 42 is set by the operation of the switch SW1 into a state in which a normal time count is executed. In the circuit shown in FIG. 1 the decoders 36 to 41 may be omitted and, instead, the output terminals of the AND gates 30 to 35 be connected to the decoders 15 to 20 through OR gates connected to the output terminals of the AND gates 9 to 14.

Where it is desired to set the electronic timepiece of FIG. 1 into the normal time count operation mode the flip-flop circuit 42 is set by the operation of the switch SW1 to cause the AND gates 9 to 14 to be enabled. Where it is desired to set the electronic timepiece into the stopwatch operation mode the flip-flop circuit 42 is reset by the operation of the switch SW1, causing the AND circuits 30 to 35 to be enabled. Then, the flip-flop circuit 43 is set by the operation of the switch SW2 to cause the AND gate 22 to be enabled. In the stopwatch operation mode a time continuously varying in units of a 1/100 second is displayed in a 1/100-second digit display section.

Where in the stopwatch operation mode the unit of time to be counted is equal to, or smaller than, the cycle of a common input signal (LCM signal) of a dynamic drive type liquid-crystal display unit, if such a time count data varying at such a small time interval is displayed, a voltage applied to the liquid-crystal display device has a total of polarity time intervals of one polarity in a predetermined period of time which is unbalanced with respect to the total of polarity time intervals of the opposite polarity which occur in the same period of time, as will be later described.

In the circuit shown in FIG. 2 the scale of ten counter 24 is driven by a 100 Hz output pulse from the frequency divider 23 of FIG. 1 and the count data bits of the counter 24 are supplied through AND gates 30-1 to 30-4 to the 1/100 digit decoder 36, i.e., the decoder for the diplay digit in the 0.01 second digit position. The decoder 36 decodes the count signals of the scale of ten counter 24. The decoded signals of the decoder 36 are supplied through exclusive OR circuits 44 to 50 to a display section 21-1. By so doing, a count value corresponding to a 1/100-second digit is displayed on a 7-segment pattern on the display section 21-1, the seven segments being arranged in a figure-of-"8" pattern and facing a common electrode. The LCM signal is supplied to the other input terminal of each of the exclusive OR circuits 44 to 50 and to the common electrode.

FIG. 3 shows a signal waveform diagram for explaining the operation of the circuit of FIG. 2. The waveform P1 illustrates the 100 Hz output pulse signal of the frequency divider 23 for frequency dividing output pulses from the oscillator 1. A crystal oscillator normally used for electronic timepiece generates a 32.768 KHz output pulse signal and the output pulse signal of the crystal oscillator is frequency divided by a normal frequency divider down to a 100 Hz pulse signal. The waveform of the pulse signal is irregular as will be understood from the waveform P1. The waveform P2 illustrates a 32 Hz LCM signal to be applied to the common electrode of the display section. Waveform P3 illustrates a data signal supplied from the decoder 36 to the exclusive OR circuit 47 when the counter 24 has its contents counted up in response to the pulse signal as indicated by the waveform P1, i.e., when the contents of the counter 24 are varied from "0" to "9" in accordance with 10 pulse signals from the frequency divider 23. As shown relative to the P1 waveform, the first positive transition in the pulse train switches counter 24 to the zero state and the leading edge of every tenth pulse thereafter returns the count to zero. Five decimal counting cycles are depicted by the P1 pulse train. The P3 data signal shows a high level "H" (a display state) when the content of the counter 24 is "0", "2", "3", "5", "6", "8" or "9" and a low level "L" (a non-display state) when the content of the counter 24 is "1", "4" or "7". Waveform P4 shows the segment signal supplied from the exclusive OR circuit 47 to control the lower segment LS in the display section 21-1 (FIG. 2). Waveform P5 shows the voltage level of the segment LS of the display section 21-1 responsive to exclusive OR 41 with respect to the common voltage. As will be understood from the waveform, the segment signal shows a "0" when the content of the counter 24 is "1", "4" or "7" and it is not lighted. It is desired that the integrated valve of this signal over a predetermined period of time be zero. However, the total of positive voltage time intervals in one second of the segment signal P5 for the example shown in the FIG. 2 circuit is 343.750 milliseconds, while the total of negative voltage time intervals in that period of the segment signal is 390.625 milliseconds. The total of zero voltage time intervals is 265.625 milliseconds. In such segment signal, therefore, the total of the negative voltage time intervals is 46.875 milliseconds longer than the total of the positive voltage time intervals for each second. That is, during a time interval corresponding to about 5% of the total stopwatch operation mode interval one polarity of the DC voltage, for example, the negative polarity is equivalently applied to the liquid-crystal, thereby shortening the service life of the liquid-crystal display device.

SUMMARY OF THE INVENTION

It is accordingly an object of this invention to provide an electronic timepiece which can prevent the voltage applied to a liquid-crystal device from being unbalanced in respect to the total of polarity time intervals of one polarity and the total of polarity time intervals of the opposite polarity which are applied in a predetermined unit of time.

Accordingly there is provided an electronic timepiece comprising an oscillation circuit, a first time count circuit having a plurality of cascade-connected counters and adapted to execute a normal time count operation in response to an output signal of the oscillation circuit, a second time count circuit having a plurality of counters and adapted to perform a stopwatch operation in response to the output signal of the oscillation circuit, liquid-crystal means, a control circuit for selectively connecting the first and second time count circuits to the liquid-crystal means, means for generating a control signal when the second time count circuit is performing a stopwatch time counting operation and inhibiting means adapted to, when the second time count circuit is connected to the display means to permit a stopwatch operation, render ineffective an output signal of at least one of counters in the second time count circuit in response to the control signal, to thereby inhibit data corresponding to the output signal of this counter from being displayed on the display means.

DETAILED DESCRIPTION OF THE PREFERRED EMBODIMENTS

An electronic timepiece according to one embodiment of this invention will now be explained below by referring to FIG. 4.

Figure 1:
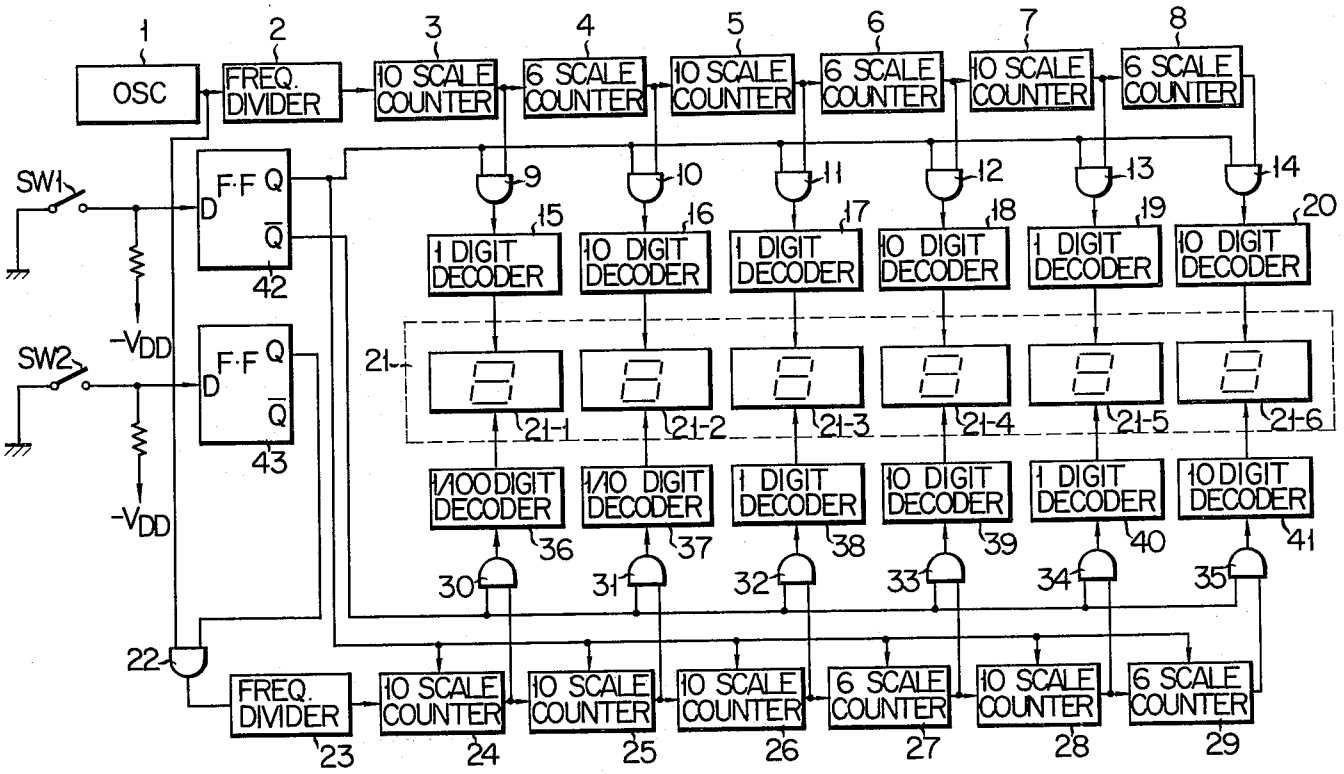
FIG. 1 PRIOR ART
FIG. 1 is a circuit diagram of the prior art electronic timepiece having a stopwatch function.
Figure 2:
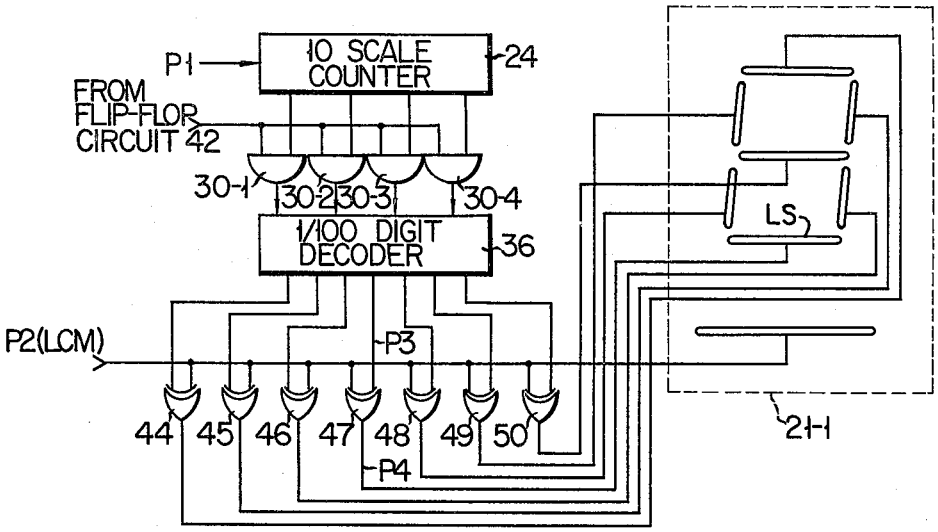
FIG. 2 PRIOR ART
FIG. 2 is a circuit diagram of a counter decoder for counting the 1/100 second digit and the corresponding display section of the electronic timepiece in FIG. 1.
Figure 3:
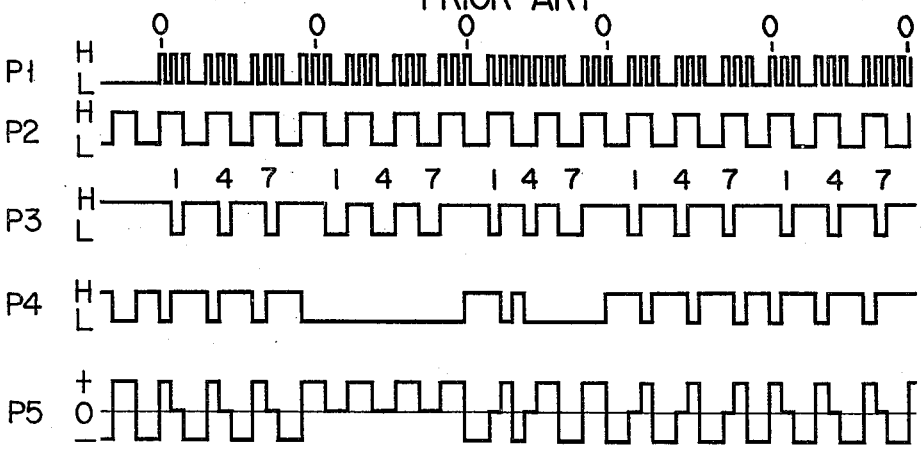
FIG. 3 PRIOR ART
FIG. 3 is a signal waveform diagram illustrating the operation of the circuit of FIG. 2.
Figure 4:
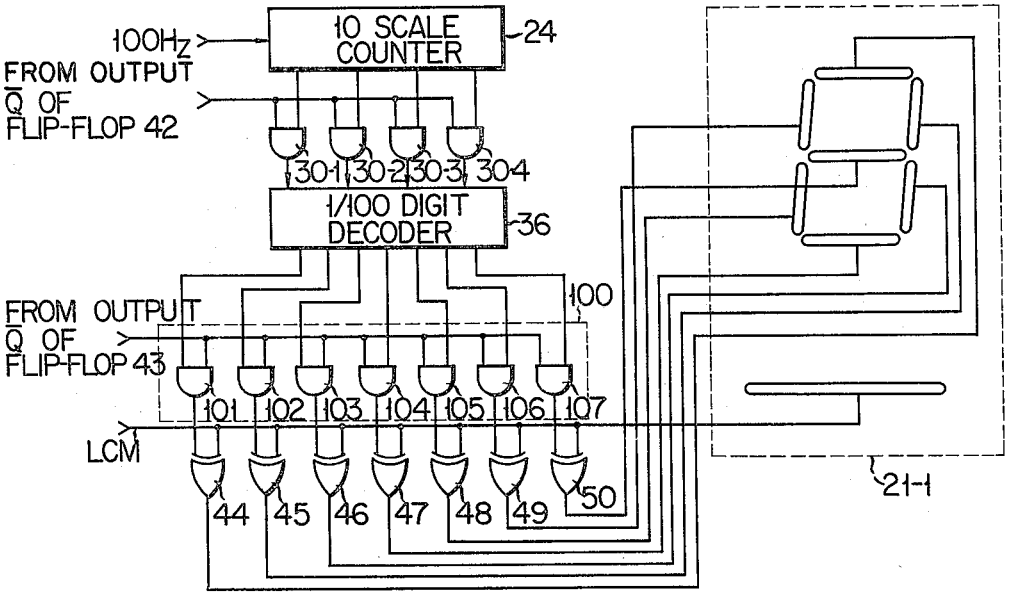
FIG. 4 is a circuit diagram showing that portion of an electronic timepiece according to one embodiment of this invention which corresponds to the prior art circuit shown in FIG. 2.

The circuit shown in FIG. 4 corresponds to the circuit shown in FIG. 2 in that it shows the circuits interfacing a display digit to the basic counter and decoder logic. Identical reference numerals are employed to designate parts or elements corresponding to those shown in FIG. 2, and further explanation thereof is omitted. The overall system arrangement employed with the circuit of FIG. 4 is constructed as shown in FIG. 1.

Referring to FIG. 4, a gate circuit 100 having AND gates 101 to 107 is connected betwen the 1/100-second digit decoder 36 and exclusive OR gates 44 to 50. The other input terminal of each of the AND gates 101 to 107 is adapted to be connected to the $\overline{Q}$ output terminal of flip-flop circuit 43 (FIG. 1).

When flip-flop circuit 42 is reset by switch SW1 (FIG. 1) to set the electronic timepiece into a stopwatch operation mode, the contents of scale of ten counter 24 is zero and a "0" is displayed on a liquid-crystal display section 21-1. When the flip-flop circuit 43 is set by operation of switch SW2 to start the stopwatch operation, a first 100 Hz pulse is supplied to the scale of ten counter 24 to cause the content of the counter to be counted up by one digit. In this case, a low level signal i.e. a first control signal, is generated from the $\overline{Q}$ output terminal of the set flip-flop circuit 43 to cause the AND gates 101 to 107 to be enabled. In the stopwatch operation mode the content of the counter 24 is not displayed on the display section 21-1. In this case, however, the contents of the other counters 25 to 29 are displayed on display sections 21-2 to 21-6, respectively. When the flip-flop circuit 43 is reset by the operation of the switch SW2 so as to stop the stopwatch operation, the current content of the counter 24, like the other counters, is held. A high level signal i.e. a second control signal is generated from the output terminal $\overline{Q}$ of the reset flip-flop circuit 43 to cause the AND gates 101 to 107 to be enabled. As a result, the content of the counter 24 is displayed on the display section 21-1. When the switch SW1 is operated to permit a switching from the stopwatch operation mode to the normal time counting mode, the flip-flop circuit 42 is set to generate a Q output signal. The Q output signal of the flip-flop circuit 42 is delivered to the counters 24 to 29 to cause the latter to be reset.

Since in the stopwatch operation mode the output signal of the decoder 36, and thus the output signal of the counter 24, is inhibited by the gate circuit 100, no display is effected on the liquid-crystal display section 21-1. When the stopwatch operation is completed, the counter displays its content. In the circuit of FIG. 4, therefore, the DC voltage applied to the liquid-crystal display section 21-1 involves no imbalance as occurring between the total of positive polarity time intervals and the total of negative polarity time intervals in a predetermined period of time. In other words, the effective polarity of the alternating energizing signal applied to the display remains substantially neutral. As a result, an unduly short service life of the liquid-crystal display section 21-1 is prevented.

Figure 5:
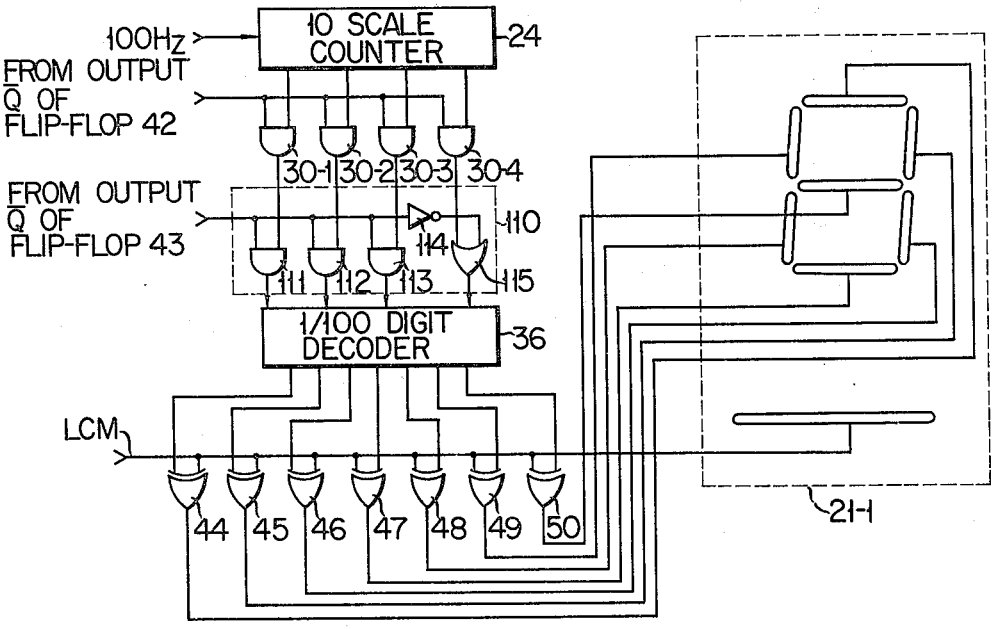
FIG. 5 is a circuit diagram showing that portion of an electronic timepiece according to another embodiment of this invention which also corresponds to the prior art circuit shown in FIG. 2.
Figure 6:
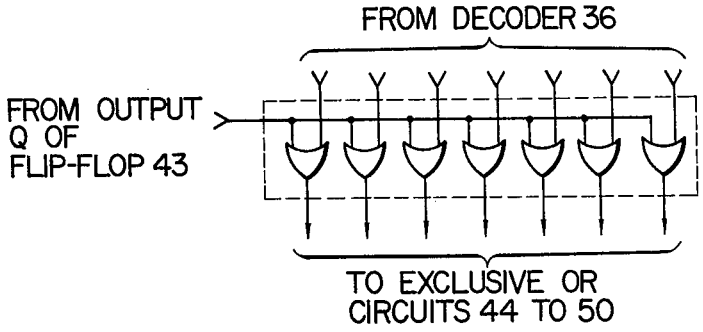
FIG. 6 is a circuit diagram showing a modification of part of the circuit of FIG. 4.

FIG. 5 shows a counter-to-display interface circuit according to another embodiment of this invention. The circuit of FIG. 5 is similar to the circuit of FIGS. 2 and 4 except that a gate circuit 110 having AND gates 111 to 113 and OR gate 115 is connected between the AND gates 30-1 to 30-4 and the 1/100-second digit decoder 36. The $\overline{Q}$ output of the flip-flop circuit 43 is connected to the other input terminal of each of the AND gates 111 to 113 and through an inverter 114 to the other input of OR gate 115.

When the electronic timepiece is set by the operation of the switch SW1 (FIG. 1) into the stopwatch operation mode, the content of the scale of ten counter 24 is zero and the display secton 21-1 displays a "0". Next when the flip-flop circuit 43 is set by the operation of the switch SW2, the content of the counter is counted up at a rate of one digit per 1/100 second. In this case, a low level signal is generated from the $\overline{Q}$ output terminal of the set flip-flop circuit 43 and it is delivered to the AND gates 111 to 113 to cause the latter to be disenabled. The low level signal is also passed through the inverter 114 and then as a high level signal via OR 115 to fourth input terminal of the 1/100-second digit decoder 36. Output signals, i.e. high level signals, representative of "8" appear on the output lines of the 1/100-second digit decoder 36 and they are supplied to the display section 21-1 where a figure "8" is displayed. That is, during the stopwatch mode of operation, the figure "8" is displayed on the display section irrespective of the content of the counter 24.

When the flip-flop circuit 43 is reset by the operation of the switch SW2 so as to stop the stopwatch operation, the current content of the counter 24, like the other counters 25 to 29, is held. A high level signal is generated from the $\overline{Q}$ output terminal of the reset flip-flop circuit 43 and it is supplied to the AND gates 111 to 113 to cause the latter to be enabled. The $\overline{Q}$ output terminal of the flip-flop circuit 43 passes through the inverter 115 and then as a low level signal to the OR gate 115. As a result, the content of the counter 24 is displayed on the display section 21-1.

Since in the stopwatch operation mode the liquid-crystal display section 21-1 of FIG. 5 displays, for example, "8" irrespective of the content of the counter, there is no possibility that the DC voltage applied to the liquid-crystal display section will suffer an imbalance between the total of positive and negative polarity time intervals in a predetermined period of time.

Although this invention has been explained in connection with the above-mentioned specific embodiments, the scope of the invention should not be limited to the particular details thereof.

For example, OR gates whose input terminals are connected to the Q output terminals of the flip-flop circuit 43 may be used in place of AND gates 101 to 107 in the circuit of FIG. 4 to display "8" on the display section 21-1 during the stopwatch operation mode. Furthermore, the gate circuit 100 may be constructed of a combination of AND or OR gates to display any suitable figure on the display section 21-1 in the stopwatch operation mode.

Figure 7:
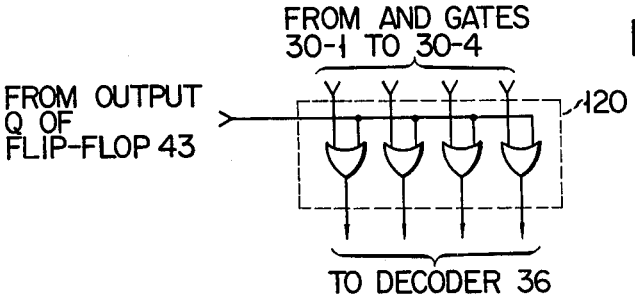
FIG. 7 is a circuit diagram showing a modification of part of the circuit of FIG. 5.

A gate circuit 120 employing OR circuits as shown in FIG. 7 can be used in place of the gate circuit 110 of FIG. 5. In this case, during the stopwatch operation, signals are supplied in a "1,1,1,1" mode to the decoder 36 to cause the output signals of the decoder 36 to become all zeros, thereby inhibiting any display on the display section 21-1.

Figure 8:
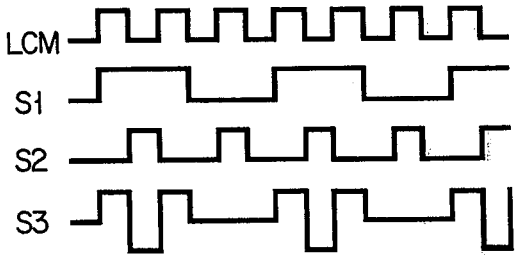
FIG. 8 is a signal waveform diagram illustrating an adverse effect on the dynamic crystal display which can occur even when time is measured in time units longer than the period of the LCM signal.

Although in the above-mentioned embodiment the stopwatch-mode time count operation has been explained as being effected at a time shorter in cycle than the LCM signal (32 Hz), the technique of this invention can also be applied to an electronic timepiece of a type in which a stopwatch-mode time count operation is effected at a time unit (for example, 1/10 second) longer than the LCM signal, but shorter than 1 second, and in which a voltage applied to the liquid-crystal display device also suffers the above-mentioned imbalance.

Where as shown, for example, in FIG. 8 a signal S1 having a period longer than the LCM signal (32 Hz), but shorter than 1 second, is generated from the decoder for decoding output count signals from the counter, a segment signal S2 applied to the display section is generated as shown in the figure and in consequence the voltage between the common electrode and the segments in the display section will be as shown in a waveform S3. This indicates that the voltage applied to the liquid-crystal display section sufers the above-mentioned imbalance. In this case, therefore, the circuit of the invention as shown in FIG. 4 or 5 can be used for the affected display section, for example, the 1/10 second display digit.

What we claim is:

1. An electronic timepiece comprising an oscillation circuit, a first time count circuit for performing an ordinary time count operation in response to an output signal of the oscillation circuit, a second time count circuit having a plurality of counters and adapted to perform a stopwatch time counting operation in response to an output signal of the oscillation circuit, liquid-crystal display means including a plurality of display sections, decoder means for decoding output count signals of said first and second time count circuits and delivering decoded output signals to said display means, a control circuit for connecting said first and second time count circuits selectively to said display means, said control circuit including means for generating a first control signal when said second time count circuit is performing a stopwatch time counting operation and a second control signal when said stopwatch time counting operation is terminated, and count display inhibiting means adapted, when said second time count circuit is connected by said control circuit to said display means to permit a stopwatch time counting operation, to render ineffective the count output signal of at least one counter in said second time count circuit supplying signals at a frequency in excess of 1 Hz., said count display inhibiting means including gating means for passing data from said second time count circuit to said display means, said gating means being gated off by said first control signal and gated on by said second control signal, and said inhibiting means being further adapted to supply a predetermined display signal to the corresponding display section in said display means irrespective of the count output signal of the counter, the counters supplying count output signals at a frequency below 1 Hz. continuing to supply said signals to said display means to permit display of counting data.

2. An electronic timepiece according to claim 1, in which said count display inhibiting means includes an AND circuit disposed between said decoder circuit and the corresponding display section in said display means and adapted when said second time counter circuit performs the stopwatch operation, to be disenabled by a control signal generated from said control circuit.

3. An electronic timepiece according to claim 2, in which the display section of said display means is comprised of segments arranged display the digit "8", and said AND circuit includes seven AND gates connected between said decoder circuit and seven segments in the corresponding display section in said display means.

4. An electronic timepiece according to claim 1, in which said count display inhibiting means includes an OR circuit the input terminals of which are connected between said control means and the decoder circuit and the output terminal of which is connected to the corresponding display section in said display means.

5. An electronic timepiece according to claim 4, in which the display section of said display means comprises seven segments arranged to display the digit "8" and said OR circuit includes seven OR gates connected between said decoder circuit and the seven segments in the corresponding display section in said display means.

6. An electronic timepiece according to claim 1, in which said count display inhibiting means includes a logic circuit connected between said decoder circuit and at least one counter in said second time count circuit and adapted when said second time count circuit performs the stopwatch operation, to supply a predetermined output signal to said decoder circuit in response to a control signal generated from said control circuit.

7. An electronic timepiece according to claim 6, in which said logic circuit includes a plurality of OR gates connected between said control circuit and the output terminal of at least one counter in said second time count circuit.

8. An electronic timepiece according to claim 6, in which said logic circuit includes at least one AND gate an output of which is inhibited by a control signal generated when said second time count circuit performs the stopwatch operation, and at least one OR gate for receiving an inverted version of the control signal.

9. An electronic timepiece according to claim 1, in which said at least one counter of said second time count circuit is adapted to count a 1/100 second digit.

10. An electronic timepiece according to claim 1, in which said at least one count circuit of said second time counter is adapted to count a 1/10 second digit.

11. An electronic timepiece comprising an oscillator, a first time count circuit for performing a normal time count operation in response to the output signal of the oscillator, a second time count circuit for performing a stopwatch time counting operation in response to an output signal of said oscillator, liquid-crystal display means for displaying the contents of said first and second time count circuits, means for generating a first control signal in response to the commencement of a stopwatch time counting operation by said second time count circuit and a second control signal in response to the termination of said stopwatch time counting operation, and count display inhibiting means adapted, when said second time count circuit performs said stopwatch time counting operation, to inhibit the operation of a portion of said display means which is arranged to respond to a signal from said second time count circuit which changes at a frequency in excess of 1 Hz, said count display inhibiting means including gating means for passing data from said second time count circuit to said display means, said gating means being gated off by said first control signal and gated on by said second control signal, the portion of said display means which is arranged to respond to a signal from said second time count circuit which changes at a frequency below 1 Hz. continuing to display counting data.

12. An electronic timepiece according to claim 1, in which said second time count circuit includes counters for counting a 1/10 second digit and a 1/100 second digit, the count output signals of both said counters being rendered ineffective by said count display inhibiting means during said stopwatch time counting operation and said inhibiting means operating to supply predetermined display signals to the display sections corresponding to both said 1/10 second and 1/100 second digits.

* * * * *